United States Patent [19]

Yoshimura et al.

[11] Patent Number: 4,823,422

[45] Date of Patent: Apr. 25, 1989

[54] FLOOR SWEEPER

[75] Inventors: Kouichi Yoshimura; Tsuyoshi Ishii, both of Osaka, Japan

[73] Assignee: Yamazaki Corporation, Osaka, Japan

[21] Appl. No.: 203,176

[22] Filed: Jun. 3, 1988

[30] Foreign Application Priority Data

Apr. 13, 1988 [JP] Japan ..... 63-92190

[51] Int. Cl.[4] ..... A47L 11/33

[52] U.S. Cl. ..... 15/41 R

[58] Field of Search ..... 15/41 R–45, 15/48, 79 R

[56] References Cited

U.S. PATENT DOCUMENTS 2,166,977 7/1939 Smith ..... 15/41 R 4,498,207 2/1985 Rosendall ..... 15/41 R

*Primary Examiner*—Edward L. Roberts

*Attorney, Agent, or Firm*—Armstrong, Nikaido, Marmelstein & Kubovcik

[57] ABSTRACT

A manual cleaner has a case, a roller brush having driven rollers and mounted between the side plates of the case, wheels kept in contact with the driven rollers and mounted on axles extending in parallel with the roller bruch, and dust pans provided at both sides of the roller brush. The dust pans are formed at both sides with bearing projections rotatably received in the side plates of the case so as to be pivotable about the projections. The projections are each formed with an axle receiving hole elongated horizontally so that the axles received in the holes can move toward and away from the roller brush. Thus the wheels can move toward and away from the driven rollers while keeping the dust pans in a stationary position. The shaft of the roller brush has both ends vertically movably mounted in bearing plates provided at both sides of the case and biased by springs downwardly. Spring members integrally formed on the bearing plates extend in opposite directions to abut and urge the dust pans closed.

3 Claims, 4 Drawing Sheets

FLOOR SWEEPER

BACKGROUND OF THE INVENTION

The present invention relates to a manual cleaner in which a roller brush is rotated by the rotation of wheels to pick up dust on the floor and collect it in dust boxes in the cleaner case.

FIGS. 7 and 8 show a prior art cleaner of this type which comprises a case 41 having its bottom open, wheels 43 mounted outside of side plates 42, a roller brush 45 supported so as to extend between the side plates 42 and having driven rollers 44 mounted at both ends thereof, and dust pans 46 provided at both sides of the roller brush 45 to cover the bottom of the case. The rotation of the wheels 43 is transmitted to the roller brush 45 through the driven wheels 44 kept in contact with the wheels 43. Dust on the floor is picked up by the rotating roller brush 45 and collected in dust boxes defined by the dust pans 46 and the case 41.

Each dust pan 46 is pivotally mounted on an axle 47 for a respective pair of wheels 43. The dust pans 46 can be pivoted open downwardly to discharge the dust therein. The dust pans 46 are normally biased by metal springs 48 to such a position as to close the bottom of the case 41.

The wheels 43 are rotated by moving the cleaner back and forth on the floor. The rotation of the wheels 43 is transmitted to the roller brush 45 through the driven rollers 44. The wheels 43 and the driven rollers 44 have to be in close contact with each other while rotating to prevent them from slipping. In order to assure this, the side plates 42 are formed with horizontally elongated axle supporting cutouts 49. The wheels 43 will shift toward the driven rollers 44 so as to be pressed hard against the driven rollers when the cleaner is pushed back and forth. This will allow the torque of the wheels 43 to be transmitted to the driven rollers because the wheels 43 and the driven rollers 44 are free from slipping.

As mentioned above, the dust pans 46 are mounted on the axles 47 for the wheels 43 and the axles 47 are moved back and forth. This means that the dust pans 46 are also moved back and forth with the back-and-forth movement of the wheels 43. Thus clearances are inevitably created between the dust pans 46 and the case 41, through which the dust collected might drop out of the dust boxes.

Another problem resides in the fact that means for biasing the dust pans 46 are in the form of the springs 48 made of a metal. Mounting the metal springs 48 into the case 41 made of synthetic resin is a rather difficult and time-consuming job.

Further, the roller brush 45 has its lower part protruding from the bottom of the case 41. It requires a delicate adjustment to set the roller brush 45 at such a position that it will not press too hard against the floor surface nor too light to pick up dust on the floor.

SUMMARY OF THE INVENTION

An object of the present invention is to provide an improved manual cleaner in which the dust collected in the cleaner body will not fall with the back-and-forth movement of dust pans.

Another object of the present invention is to provide means for biasing dust pans which are easy to assemble.

A further object of the present invention is to provide means for holding a roller brush at such a position that it will be pressed against the floor surface with a suitable contact pressure.

In the present invention, the dust pans are adapted to pivot with respect to the case about the bearing projections provided at both ends of the dust pans. The axles for the wheels move back and forth in the bearing holes formed in the bearing projections. The bearing projections as well as the dust pans will not move back and forth with the back-and-forth movement of the axles. This will prevent the formation of clearances between the dust pans and the case and thus prevent the dust collected from dropping.

Since the bearing plates are made of a resilient synthetic resin, the spring members can be integrally formed with the bearing plate and can be assembled quite easily in a short time.

If the roller brush is subjected to a strong pressure from below, it will raise against the bias of the resilient members mounted in the bearing holes. When the pressure from below is not so strong, the resilient members serve to push down the roller brush into contact with the floor surface. Thus, the roller brush can always be pressed against the floor surface with an optimum contact pressure.

Other features and objects of the present invention will become apparent from the following description taken with reference to the accompanying drawings, in which:

DETAILED DESCRIPTION OF THE PREFERRED EMBODIMENT

Figure 2:
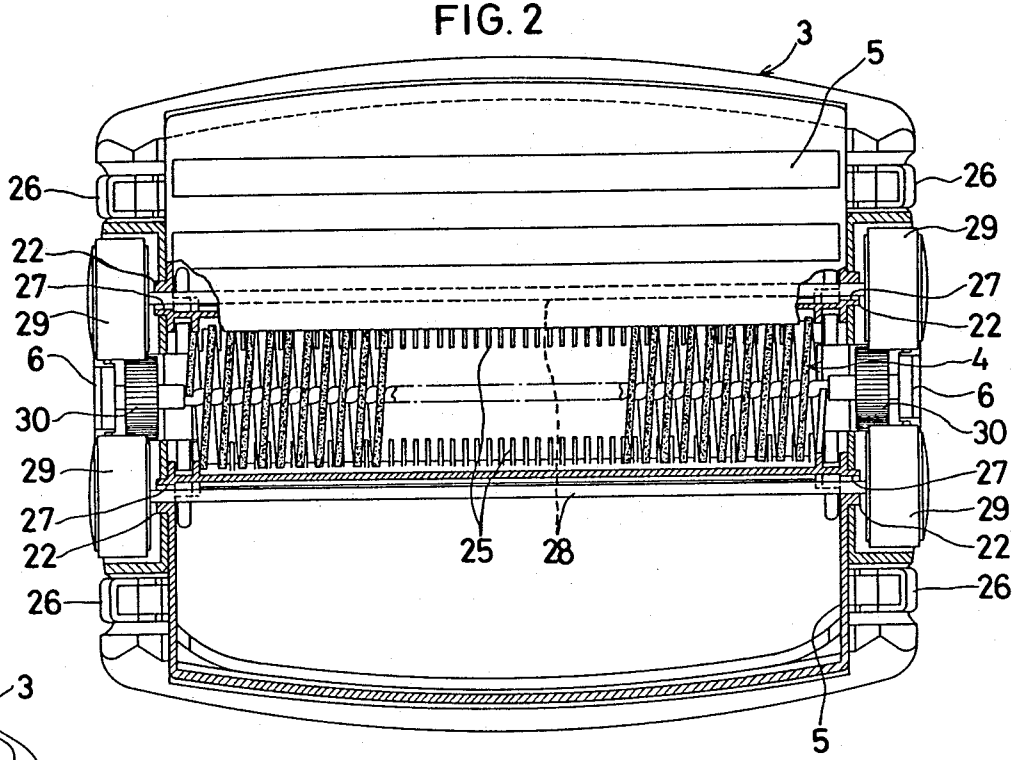
FIG. 2 is a partially cutaway bottom view of the same.
Figure 1:
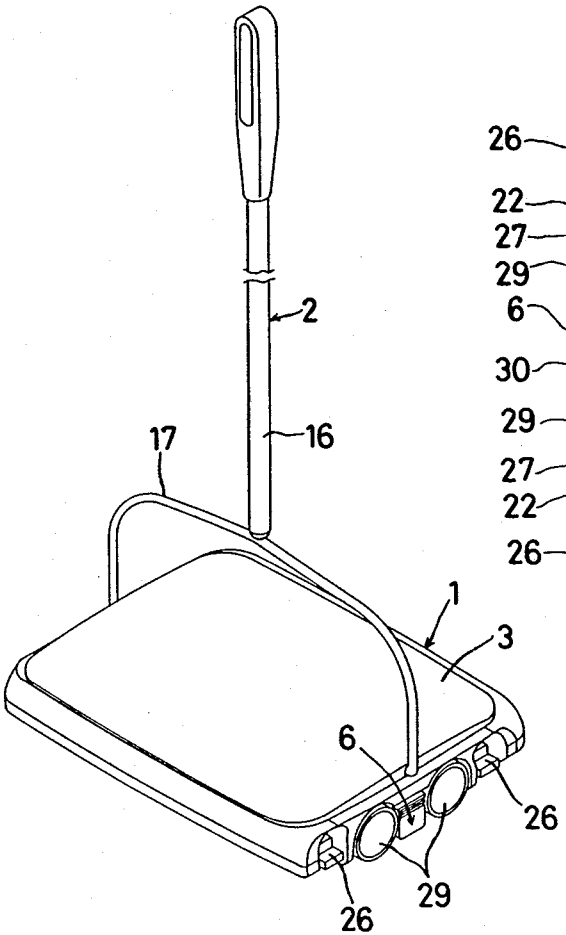
FIG. 1 is a perspective view of the manual cleaner embodying the present invention.

Now referring to the drawings, the manual cleaner according to the present invention comprises a cleaner body 1 and a handle 2 as shown in FIG. 1.

The cleaner body 1 comprises a case 3 having its bottom open, a roller brush 4 and dust pans 5 mounted on the case 3.

The case 3 has a pair of bearing plates 6 of a resilient synthetic resin mounted at both sides thereof in the center so as to oppose to each other. As will be best seen in FIG. 5, each bearing plate 6 comprises a bearing portion 7 and a mounting portion 8 integrally connecting with the former through a shoulder portion 9. The bearing portions 7 are formed at positions opposed to each other with vertically elongated bearing holes 10 in which a shaft 11 of the roller brush 4 has its ends journaled. Each mounting portion 8 is provided with a handle-mounting hole 12 formed with a plurality of axial grooves. A pair of spring rods 13 are provided at both sides of the mounting portion 8 so as to extend in opposite directions.

Figure 3:
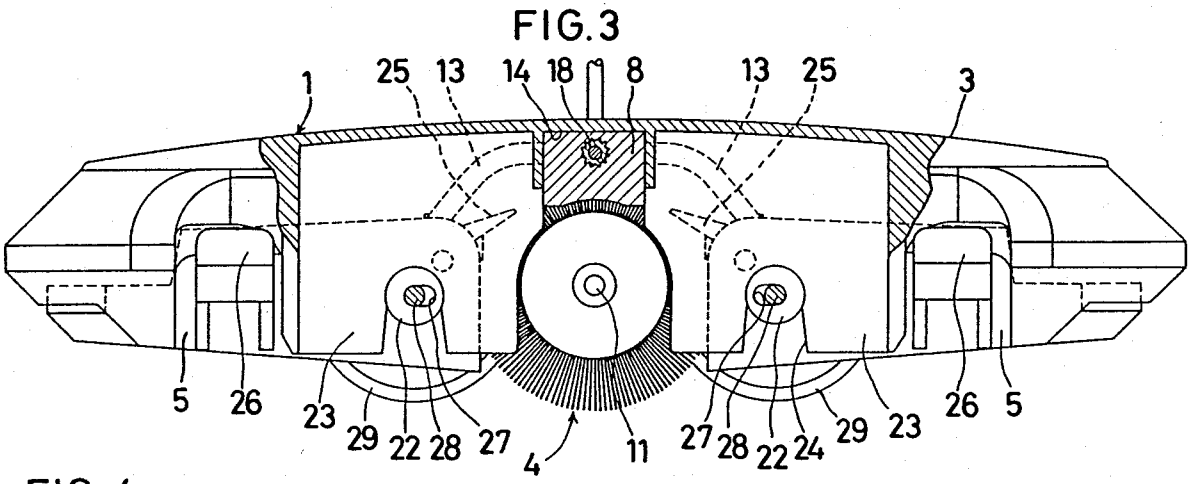
FIG. 3 is a vertical sectional side view of the same.
Figure 4:
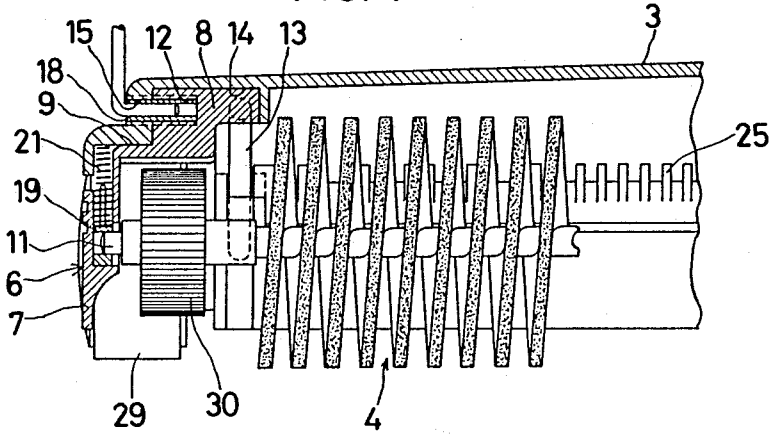
FIG. 4 is a partial vertical sectional front view of the same.

The cleaner case 3 has its inner surface at both sides shaped so as to form seating spaces 14 to snugly receive the mounting portions 8 of the bearing plates 6 as shown in FIGS. 3 and 4. When the mounting portions 8 are received in the seating spaces 14, the shoulder portions 9 are located at such a position as to engage and support the side plates of the cleaner case 3. The side plates are formed with holes 15 adapted to get aligned with the handle mounting holes 12 formed in the mounting portions 8.

Figure 5:
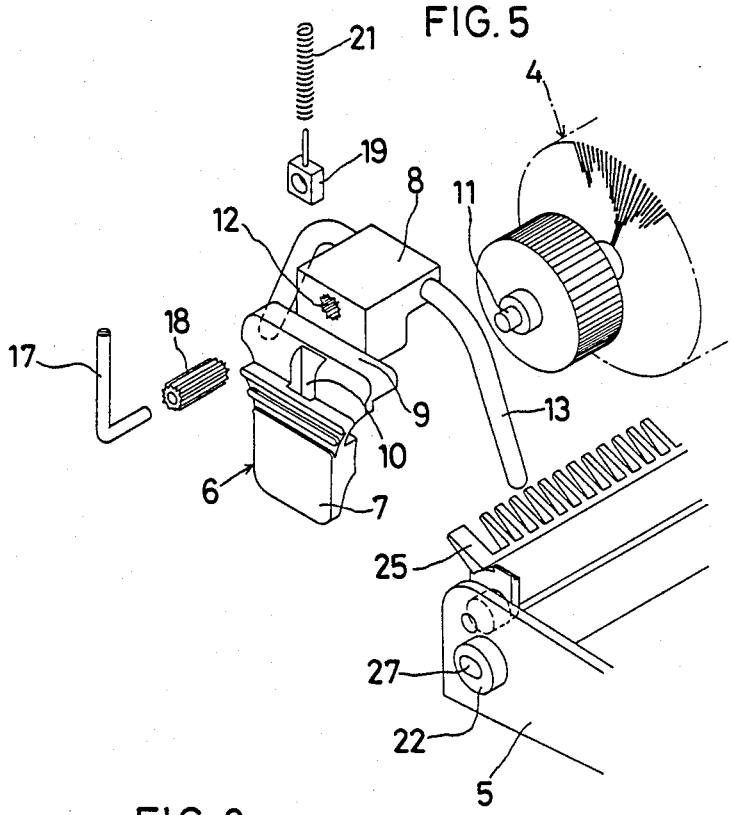
FIG. 5 is an exploded perspective view of a portion of the same.

The handle 2 has a main portion 16 and a split portion 17 (FIG. 1) having both ends thereof bent inwardly and sheathed with knurled fixing pipes 18. (FIGS. 4 and 5)

When the pipes are inserted into the handle mounting holes 12 in the bearing plates 6 through the holes 15 in the case 3, they will engage the axial grooves formed in the holes 12 so as to be unrotatably fixed in position. The split portion 17 has its ends gripped by the knurled fixing pipes 18 so as to be pivotable in the pipes only when a sufficiently large turning force is applied. Thus the handle 2 can be held at any desired angle by the friction between the ends of the shaft and the fixing pipes 18.

A bearing seat 19 is vertically slidably mounted in the bearing hole 10. The rotary shaft 11 of the roller brush 4 has its both ends received in the bearing holes 10 through the bearing seats 19. In each bearing hole 10, a resilient member 21 such as a coil spring is provided to bias the bearing seat 19 downwardly.

The dust pans 5 are mounted on the bottom of the cleaner case 3 at both sides of the roller brush 4. (FIG. 6) Dust boxes are defined by the dust pans 5 and the case 3.

As best seen in FIG. 5, each dust pan 5 is provided at both sides thereof near the roller brush 4 with bearing projections 22, which are received in cutouts 24 formed in side plates 23 of the case 3 so that the dust pan will be pivotable in the cutouts 24. A toothed member 25 is pivotally mounted on each dust pan 5 at the side facing the roller brush 4. The spring rods 13 abut the dust pans 5 at portions near both ends of the toothed members 25 to bias the dust pans 5 to their closed position. The dust pans 5 are also provided at both sides with finger-hold portions 26 (FIG. 1) and can be swung open about the bearing projections 22 by pulling down the portions 26 with fingers.

Figure 6:
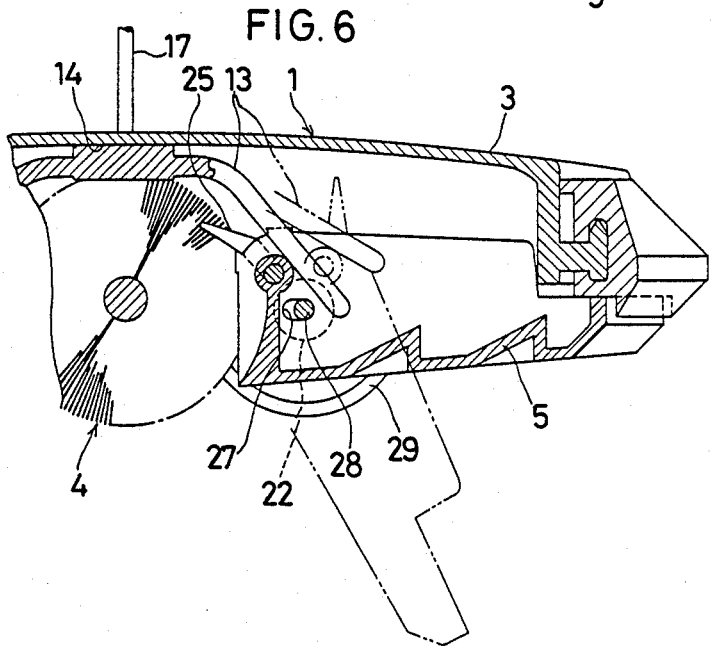
FIG. 6 is a vertical sectional side view of a portion of the same.
Figure 7:
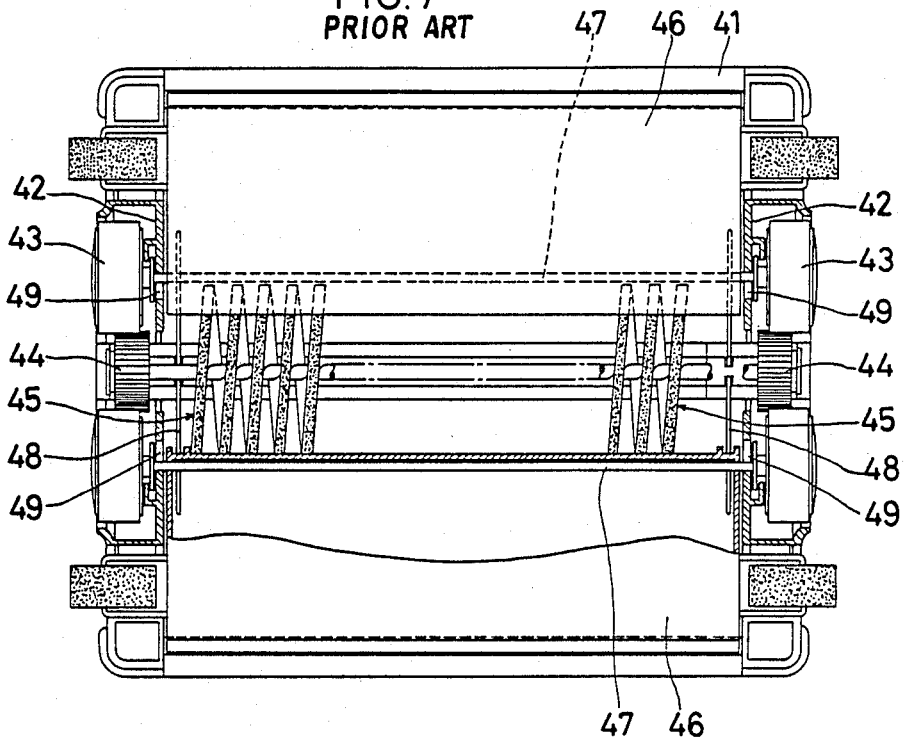
FIG. 7 PRIOR ART
FIG. 7 is a bottom view of a prior art cleaner.
Figure 8:
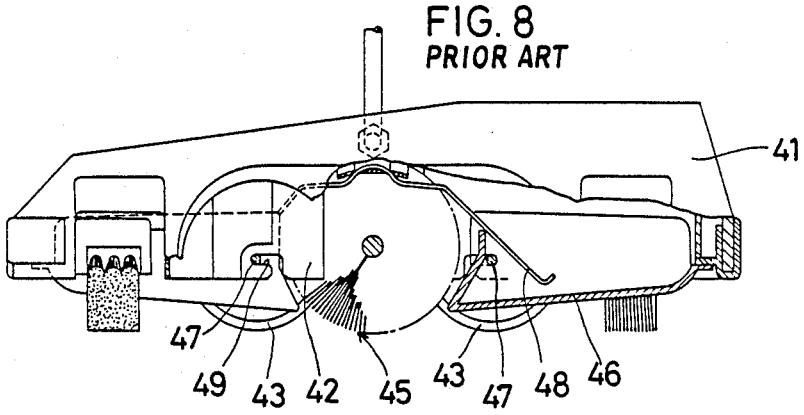
FIG. 8 PRIOR ART
FIG. 8 is a partially cutaway side view of the same.

The bearing projections 22 are each formed with a hole 27 to receive both ends of an axle 28. A pair of wheels 29 are mounted on each axle at both ends. As shown in FIGS. 3 and 6, the holes 27 are horizontally elongated to allow a back-and-forth movement of the axles 28 in the holes 27. The wheels 29 are located at front and rear of the respective bearing plates 6 so as to engage driven rollers 30 provided at both ends of the rotary shaft 11 of the roller brush 4 from both sides. The rotation of the wheels 29 is transmitted to the roller brush 4 through the driven rollers 30.

In use, the cleaner body 1 is pushed back and forth by holding the handle 2 to cause the wheels 29 to rotate by contact with the floor surface. The roller brush 4 will be rotated to pick up dust on the floor. The dust adhering to the roller brush 4 is scraped off by the toothed members 25 so as to be collected in the dust boxes on the dust pans 5.

What is claimed is:

1. A manual cleaner comprising a case having a pair of side plates and having its bottom open, wheels mounted on axles extending through said side plates, a roller brush mounted so as to extend between said side plates and substantially in parallel with said axles, driven rollers, mounted at both ends of said roller brush and driven by said wheels, said roller brush being adapted to rotate with said driven rollers, and dust pans provided at both sides of said roller brush so as to cover the open bottom of said case, dust boxes defined by said dust pans and said case for collecting dust on the floor picked up by said roller brush, said each dust pan being formed at both sides thereof with bearing projections rotatably received in said side plates of said case so as to be pivotable about said bearing projections, said each bearing projection being formed with an axle mounting hole elongated in a horizontal direction so as to allow said axles received in said axle mounting holes to move only in a direction toward and away from said roller brush, whereby bringing said wheels into and out of contact with said driven rollers.

2. A manual cleaner as claimed in claim 1, further comprising a pair of bearing plates of a resilient synthetic resin mounted, one on each side of said case opposite to each other and each formed with a bearing hole at a position opposite to each other so as to receive both ends of a shaft of said roller brush, and spring means integrally formed on said bearing plates at inner portions thereof so as to bias said dust pans toward their closed position.

3. A manual cleaner as claimed in claim 2, wherein said bearing holes are elongated vertically so as to vertically movably receive both ends of said shaft of said roller brush and an elastic member is mounted in said each bearing hole so as to bias said shaft downwardly.

* * * * *